US005271390A

United States Patent [19]

Gray et al.

[11] Patent Number: 5,271,390

[45] Date of Patent: Dec. 21, 1993

[54] POSITIVE PRESSURE BREATHING ASSEMBLY AND DEMAND REGULATOR THEREFOR

[75] Inventors: Robert E. Gray, Glen Mills; Robert M. Armstrong, Clifton Heights; Walter J. D. Lybrand, Drexel Hill, all of Pa.

[73] Assignee: Cairns & Brother Inc., Clifton, N.J.

[21] Appl. No.: 851,623

[22] Filed: Mar. 16, 1992

[51] Int. Cl.[5] ..... A62B 18/10; A62B 9/04

[52] U.S. Cl. ..... 128/207.12; 128/205.24; 128/202.27; 128/206.21

[58] Field of Search ..... 128/204.18, 206.21, 128/205.24, 207.12, 202.27, 206.23, 206.28

[56] References Cited

U.S. PATENT DOCUMENTS

| | | | |
|---|---|---|---|
| 279,265 | 6/1883 | Nevius | 128/207.12 |
| 1,019,787 | 3/1912 | Guiley | 128/207.12 |
| 3,308,815 | 3/1967 | Wilcox | 128/202.27 |
| 4,126,131 | 11/1978 | Davis | 128/207.12 |
| 4,245,631 | 1/1981 | Wilkinson | 128/204.17 |
| 4,250,876 | 2/1981 | Kranz | 128/202.22 |
| 4,741,332 | 5/1988 | Beaussant | 128/201.23 |
| 4,997,217 | 3/1991 | Kunze | 285/387 |
| 5,097,826 | 3/1992 | Gray | 128/204.18 |

FOREIGN PATENT DOCUMENTS

| | | | |
|---|---|---|---|
| 89285 | 9/1983 | European Pat. Off. | 128/204.18 |
| 410311 | 3/1925 | Fed. Rep. of Germany | 128/202.27 |
| 2609034 | 9/1977 | Fed. Rep. of Germany | 128/202.27 |
| 1560234 | 4/1990 | U.S.S.R. | 128/206.21 |

*Primary Examiner*—Edgar S. Burr
*Assistant Examiner*—Eric P. Raciti
*Attorney, Agent, or Firm*—R. Gale Rhodes, Jr.

[57] ABSTRACT

A self-contained breathing assembly of the positive pressure type including a remotely positioned improved pressure demand regulator for substantially instantaneous response for breathing air having reduced operating parts substantially reducing potential breakdown and wherein there is provided a gas flow disconnect assembly between the user facepiece and gas conduits.

28 Claims, 4 Drawing Sheets

22
26
180
184
182
186
184
190
192
194
188
"A"
134
146
154
160
152
158
136
160
148
200
172
150
164
156
166
"B"
142
170
162
144
122
140
124
120
138
132
176
174
FLOW
PRESSURE 22
26
134
146
148
136
200
172
160
170
122
164
124
162
120
166
132
196
198
176
174
FLOW
PRESSURE

POSITIVE PRESSURE BREATHING ASSEMBLY AND DEMAND REGULATOR THEREFOR

BACKGROUND OF THE INVENTION (1.) Field of the Invention

This invention relates to a self-contained breathing assembly, and more particularly to an improved positive pressure self-contained breathing assembly for temporary use by a wearer in a noxious environment, such as is worn by a firefighter and including a remotely positioned pressure demand regulator as well as an improved facepiece interconnect assembly.

(2) Description of the Prior Act

Self-contained breathing assemblies (SCBA's) are worn by industrial workers, and in particular firefighters, to provide a safe, respirable breathing condition while the user works in a hostile environment. Currently, breathing performance and service life rating of such apparatus are based upon user consumption at the rate of 42 liters per minute, wherein inhalation and exhalation reach peak instantaneous flow rates of about 115 liters per minute. For firefighting duty, the National Fire Prevention Administration (NFPA) has defined new performance standards in its Standard No. 1981 (for open circuit SCBA's) wherein peak instantaneous breathing rates exceed 400 liters per minute.

Such demand regulators must be highly responsive to meet the constantly-changing pattern of human respiration and peak instantaneous flow rates of up to 400 liters per minute. Pressure-demand regulators create a positive pressure in the user's facepiece throughout the respiration cycle while concomitantly providing flow corresponding to the user's demand, such as disclosed in U.S. Pat. No. 4,334,532 to Jackson. Such a pressure-demand regulator normally maintains a positive pressure of about 0.5 to 1.5 inches water-column height under static conditions (when the user is not breathing) and does not permit the facepiece pressure to become negative at peak flow rates of up to 400 liters per minute.

The demand regulator may be mounted on the face piece to provide an almost instantaneous response to the user's respiratory demand, however the bulkiness restricts vision and can restrict head movement resulting from its size and hose coupling requirements. Conversely, in known designs, the regulator's response time decreases considerably if the regulator is located a distance from the facepiece, and the two are joined by a large diameter flexible tube, although the remotely located regulator affords unencumbered vision and head movement.

One problem with demand regulators used debris-ridden and/or subfreezing environments, routinely encountered in firefighting, is that the regulator's operation may be hindered by ice and/or debris. Additionally, any debris entering the breathing tube or regulator before the facepiece is donned can be blown into the wearer's face during use. One solution to this problem is the provision of a cap to be manually positioned over the regulator outlet after use.

A further problem for any pressure demand regulator is the continued flow of gas when the regulator is disconnected from the facepiece since the regulator will continue to flow to try to create a positive pressure.

OBJECTS OF THE INVENTION

An object of the present invention is to provide an improved self-contained positive pressure breathing assembly having a demand regulator located remotely from the facepiece to provide a rapid response to the user's breathing effort by using separate hoses between the facepiece and the regulator for the functions of fluid flow and pressure sensing but permitting of improved head movement and scope of vision.

Another object of the present invention is to provide an improved self-contained breathing assembly having a pressure demand regulator of improved responsiveness and reduced complexity to minimize potential breakdown.

Still another object of the present invention is to provide an improved positive pressure self-contained breathing assembly having automatic shut-off capabilities.

Yet another object of the present invention is to provide an improved self-contained positive pressure breathing assembly of improved operational characteristics.

A further object of the present invention is to provide an improved self-contained positive pressure breathing assembly substantially preventing debris ingestion upon disconnection of the regulator from the facepiece.

A still further object of the present invention is to provide an improved self-contained positive pressure breathing assembly substantially instantaneously discontinuing pressurized gas flow upon disconnection of the regulator from the facepiece.

SUMMARY OF THE INVENTION

These and other objects of the present invention are achieved in a self-contained breathing assembly of the positive pressure type including a remotely positioned improved pressure demand regulator for substantially instantaneous response for breathing air having reduced operating parts substantially eliminating potential breakdown and wherein there is provided a gas flow disconnect assembly between the user facepiece and gas flow conduits.

BRIEF DESCRIPTION OF THE DRAWING

Further objects and advantages of the present invention will become apparent from the following detailed description thereof when taken with the accompanying drawings, wherein like numerals designate like parts throughout, and wherein.

DETAILED DESCRIPTION OF THE INVENTION

Figure 1:
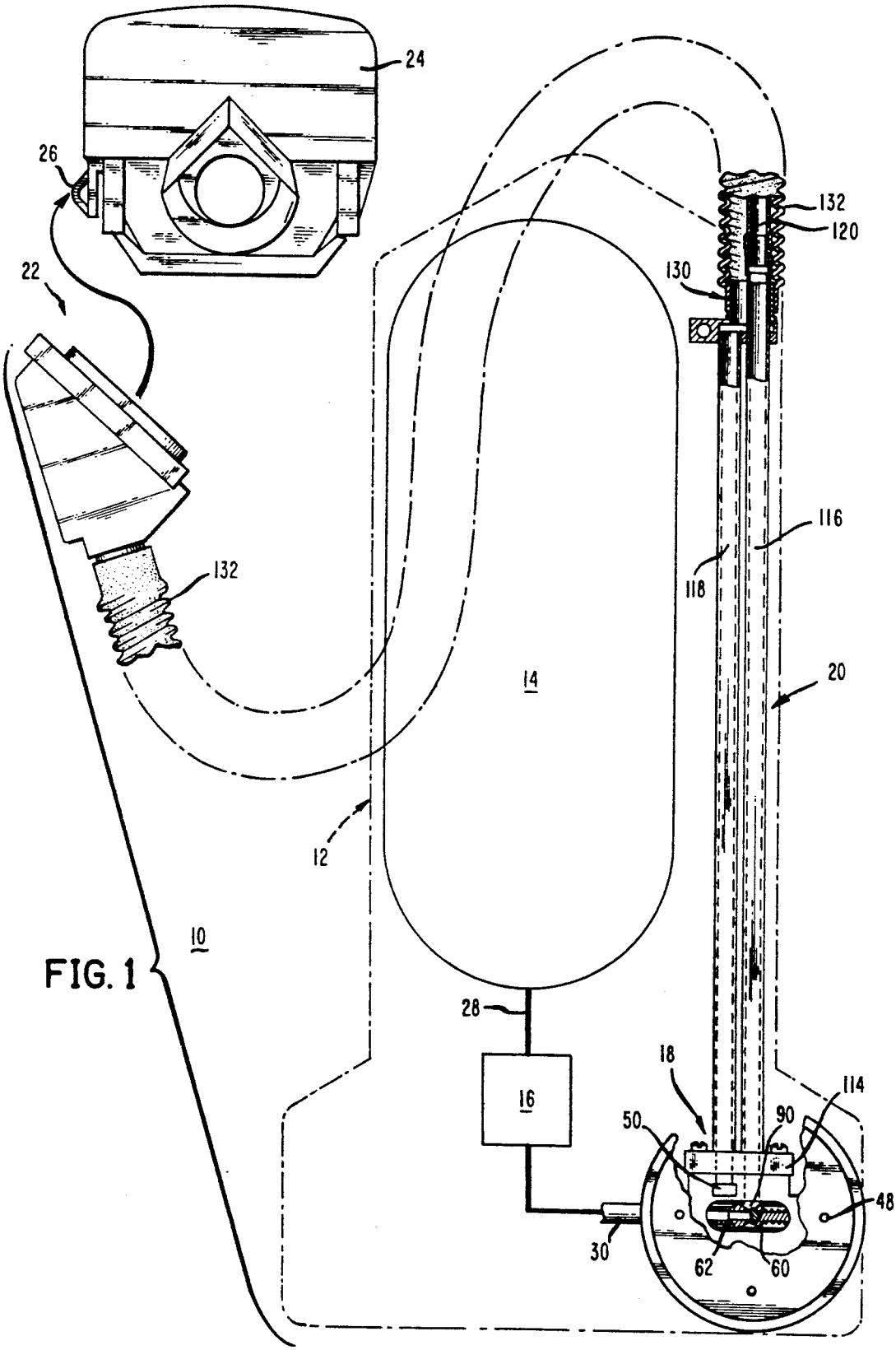
FIG. 1 is a schematic view of the positive pressure breathing assembly of the present invention.

Referring now to FIG. 1, there is illustrated a positive pressure breathing assembly of the present invention, generally indicated as 10, mounted in a supporting carrier or backpack assembly 12 (indicated by the phantom lines). The breathing assembly 10 is comprised of a compressed or pressurized breathing gas supply tank 14; a pressure reducer valve 16; a pressure demand regulator assembly 18; a gas supply conduit assembly, generally indicated as 20; a valve-facepiece connecting assembly, generally indicated as 22, and a facepiece 24 including a gas connect member 26. The compressed or pressurized breathing gas supply tank 14 (containing a breathable gas, most commonly air) is generally of a size to provide about 1200 liters of breathing air (which has classically been rated a "30 minute" cylinder in that it provides 30 minutes of service at a 42 liter per minute user consumption rate), but tanks having capacities considerably larger (up to 2400 liters) or smaller (down to 400 liters) may also be used. The cylinder is connected by line 28 under the control of the pressure reducer valve 16 via a conduit 30 to the pressure demand regulator assembly 18.

Figure 2:
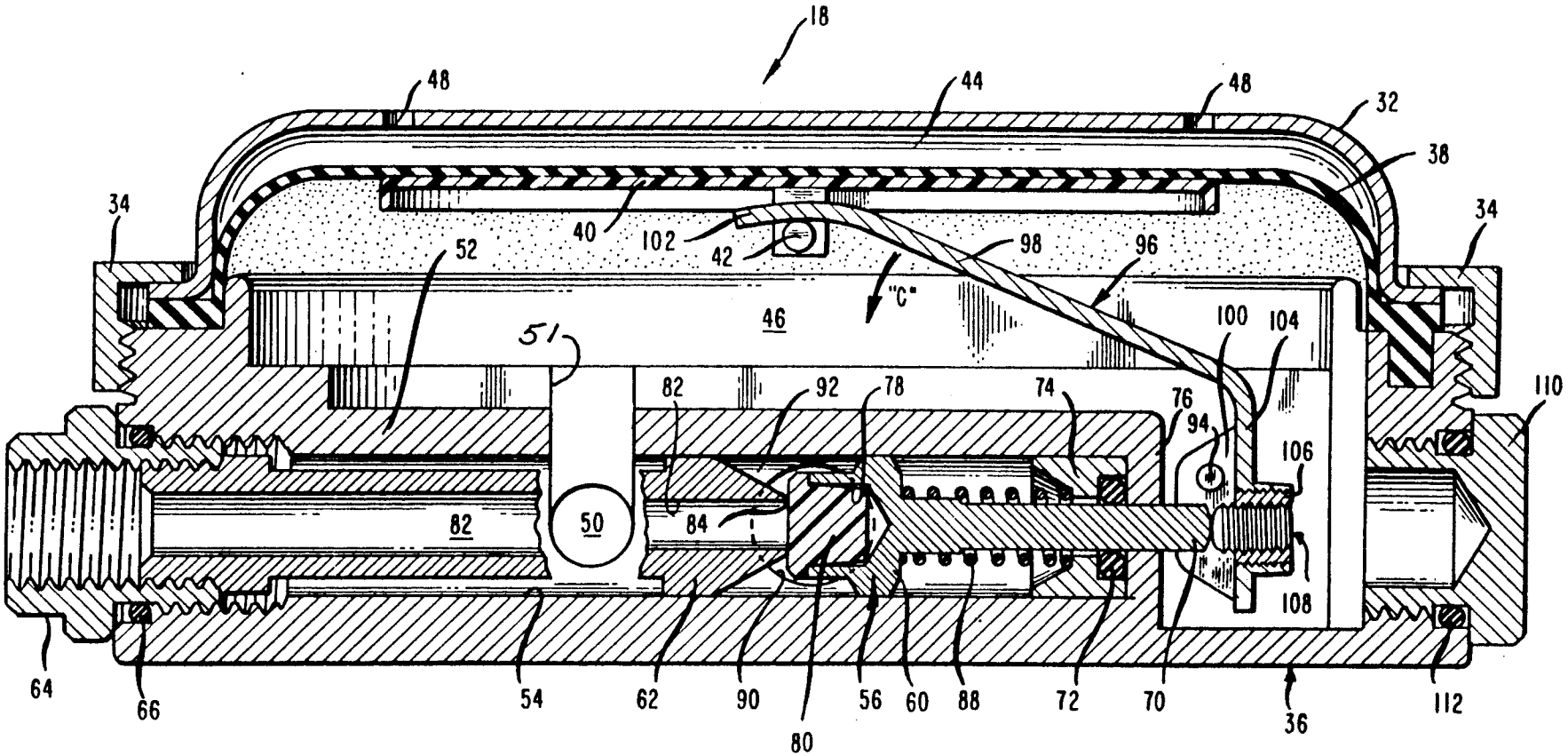
FIG. 2 is an enlarged cross-sectional view of the pressure demand regulator assembly.

The pressure demand regulator assembly 18, referring to FIG. 2 is comprised of an upper cylindrically-shaped housing member 32 threadably connected by a threaded ring 34 to a lower housing member 36 having disposed therebetween a flexible diaphragm member 38 including a disc-shaped body member 40 mounted by a mounting pin member 42 defining an upper chamber 44 a lower chamber 46. The lower ring portion of flexible diaphragm member 38 acts as a gasket between the upper and lower housing members 32 and 36. The upper housing member 32 is provided with channels 48 for fluid flow communication between the atmosphere and the upper chamber 44 of the pressure demand regulator assembly 18. A fluid passageway and an opening 50 is provided in the lower housing member 36 to provide fluid communication between the lower chamber 46 and the pressure sensing conduit 118 of gas supply conduit assembly 20, as more fully hereinafter described.

The lower housing member 36 is provided with an air inlet housing 52 formed with a cylindrically-shaped chamber 54 for positioning an air valve release assembly, generally indicated as 56. The air valve release assembly 56 is comprised of a piston 60, nozzle member 62 and an inlet fitting 64 threadably positioned within the inlet chamber 54 together with an appropriate gasket member 66 which is threadably joined and sealed to the nozzle member 62. The piston 60 includes a free end portion 70 extending in fluid tight relationship through a gasket 72 which is contained between bushing 74 and an end wall 76 of the housing 52 into the lower chamber 46. The piston member 60 is formed with a chamber 78 in an end opposite the free end portion 70 for receiving a resilient valve pad 80. The nozzle member 62 includes a centrally-formed channel 82 terminating in a nozzle tip 84. The nozzle tip 84 is in contact with the resilient valve pad 80.

A coil spring 88 (under compression) is disposed about the piston 60 between a shoulder of the piston 60 and bushing 74. The air inlet housing 52 is provided with an orifice 90 in fluid communication with a feed gas chamber 92 formed about an outer surface portion of the piston 60 and nozzle member 62 with the inlet chamber 54 proximate the nozzle tip 84 of the intermediate nozzle member 62, as more fully hereinafter described.

In the chamber 46 proximate the end wall 76 of the inlet housing 52, there is provided an inwardly extending shaft member 94 for positioning a lever member, generally indicated as 96, including hinge arm 98 and a channel 100 pivotably mounted on the shaft member 94. An upper end portion 102 of the lever member 96 extends through and is in contact with the pin member 42. A lower end portion 104 of the lever member 96 is formed with an outwardly extending threaded insert 106 which contains an oval head set screw 108 extending towards and in contact with the free end portion 70 of the piston 60 thereby allowing adjustment of the height of lever 96, as more fully hereinafter described. The threaded set screw 108 allows adjustment to the height of the hinge arm 96 to offset variations in production parts. Access to the screw 108 is gained by removing access part 110 sealed by gasket 112.

The gas supply conduit assembly 20, referring again to FIG. 1, is provided with a connecting member 114 connected to the lower housing 36 of the pressure demand regulator 18 and includes conduits 116 and 118 in fluid flow communication with orifices 90 and 50, respectively, formed in the lower housing member 36 of the pressure demand regulator assembly 18.

The upper portion of rigid conduit 116 is threadably connected to flexible conduit 120. The other end of flexible conduit 120 is connected to a downwardly extending conduit element 122 (FIG. 3) of the connecting assembly 22 and is in fluid flow communication with one side at the conduit element separated by a partition 124, which allows the conduit element 122 to act as a mixing chamber between the fluid flow conduit 120 and the pressure-sensing conduit 118, as hereinafter more fully described.

Figure 3:
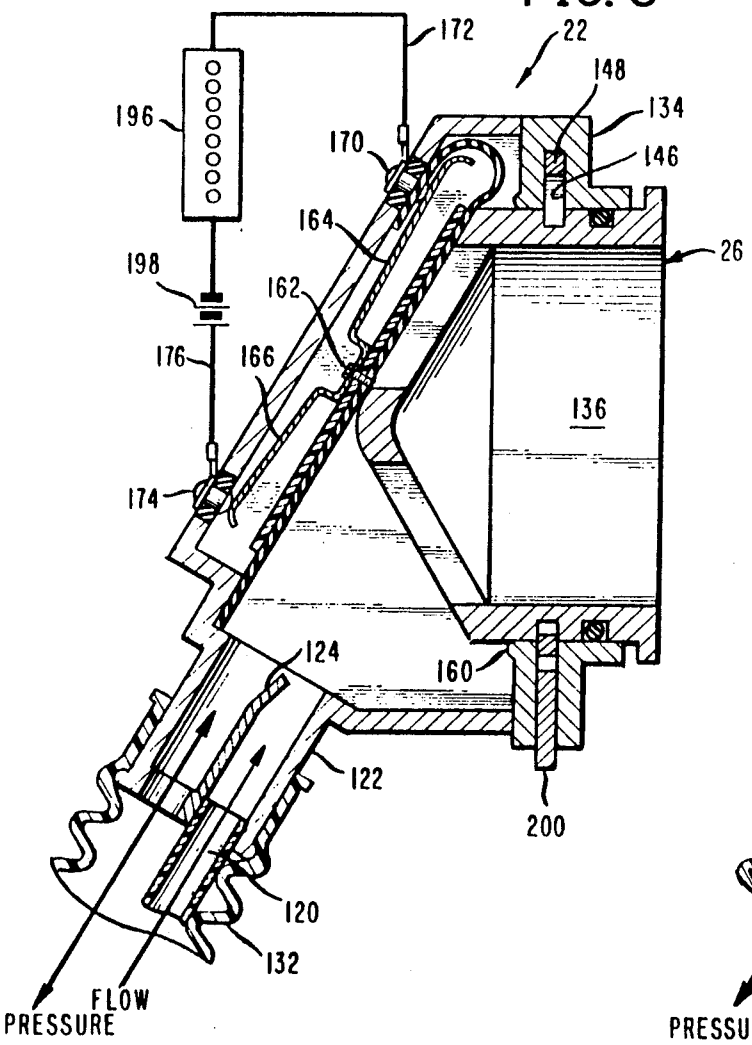
FIG. 3 is an enlarged cross-sectional view of the valve-facepiece connecting assembly.

The upper portion of the conduit 118 terminates in an end member 130 encircling the conduit 116 for fluid flow mounting to a flexible conduit 132 mounted to the end member 130 at one end and to the downwardly extending conduit element 122 of the valve-facepiece connecting member 22 at the upper end thereof, in fluid flow communication with the opposite side of conduit element (from that used for flow delivery), referring more particularly to FIG. 3. An adjustment device (not shown) may be provided, if necessary to the partition 124 to control the effect of fluid flow upon the pressure sensing conduit line. Suitable clamping elements (not shown) are provided to mount the flexible conduit 132 to the gas supply conduit assembly 20 and the valve-facepiece connecting assembly 22.

Although this invention is described with one flexible conduit member 120 contained in a coaxial manner inside a larger diameter flexible conduit member 132, it is understood that two flexible conduits having similar size diameters running parallel to each other could be used to achieve the same function.

Figure 4:
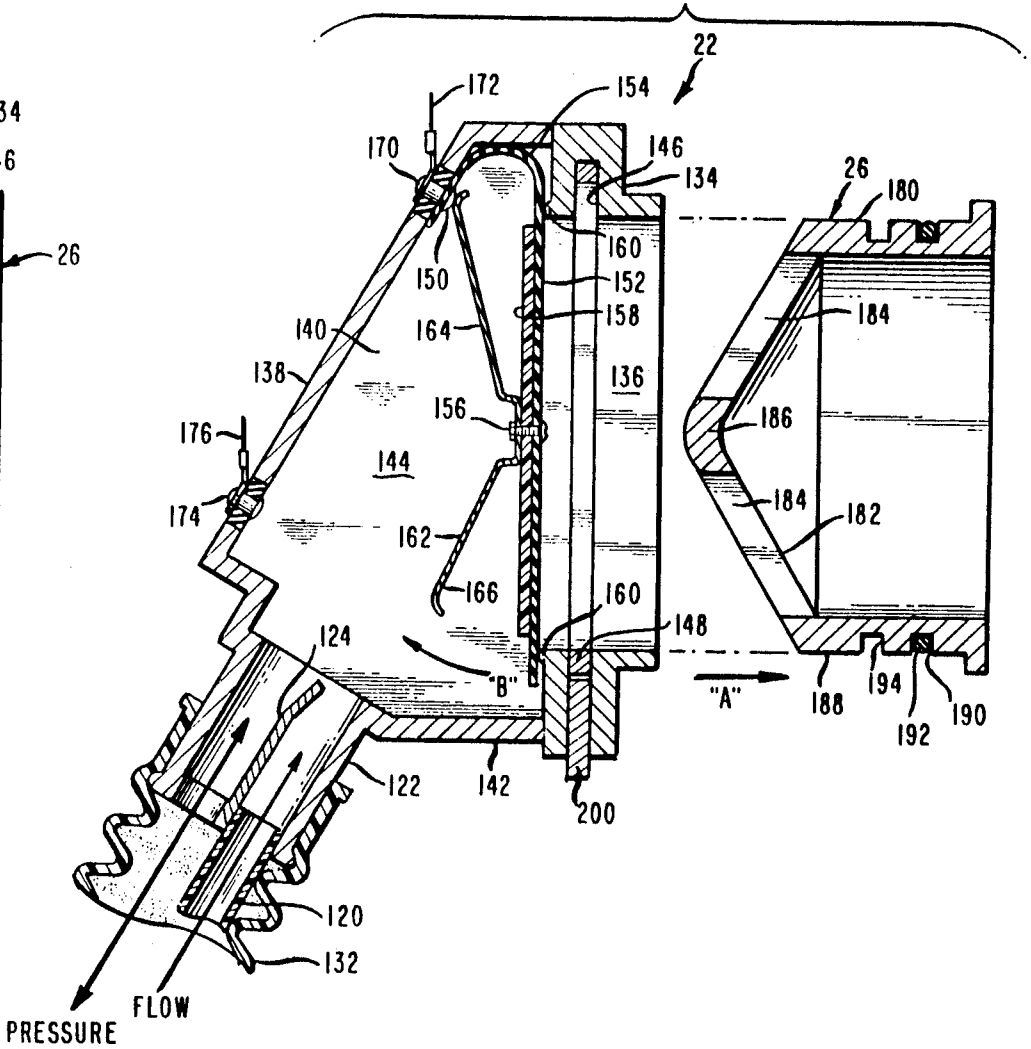
FIG. 4 is an enlarged cross-sectional view of the valve-facepiece connecting assembly of FIG. 3 in detached mode.

The valve assembly 22, referring to FIGS. 3 and 4, and particularly FIG. 4, is comprised of a generally triangularly-shaped housing formed of front wall portion 134 including a cylindrically-shaped opening 136, an angularly-disposed rear wall member 138, sidewalls 140 (one shown) and a lower wall portion 142 defining a mixing chamber 144 in conjunction with the flow pattern created in conduit element 122. About the cylindrically-shaped opening 136 in the front wall portion 134, there is formed a cylindrically-shaped groove 146 in which is disposed a U-shaped spring member 148. To the rear wall member 138, there is mounted, such as by rivet 150, a resilient flap member 152 having a upper U-shaped area portion 154 providing a basis for attaching the flap member 152 to the rear wall member 138. Mounted to the resilient flap member 152, such as by pin member 156, there is provided a rigid circularly-shaped disc member 158 concentrically disposed with respect to the opening 136 to provide rigidity to the flap member 152 in a closed configuration. An interior portion of the front wall member 134 is provided with a circularly-shaped raised or beaded portion 160 providing a suitable seating surface for the flap member 152.

A spring member 162 having an upper arm portion 164 and a lower arm portion 166 is centrally mounted by the pin member 156 together with the rigid disc member 158 to the flap member 152. The upper arm portion 164 of the spring member 162 contacts an upper inner surface portion of the rear wall 138 and is free to slide on the wall when the valve is opened to bias the resilient flap member 152 in a closed position against the bead portion 160 of the front wall portion 134, referring particularly to FIG. 4. The rear wall 138 may be provided with an upper electrical contact member 170 including lead 172 connected through wall member 138 and in slidable contact with the upper arm portion 164 and with a lower electrical contact member 174 including lead 176. The spring member 162 provides a basis for closing an electrical circuit between the upper and lower contact members 170 and 174, referring to FIG. 3 upon connecting of the valve assembly 22 to the facepiece gas connect member 26, as more fully hereinafter described.

The gas connect member 26 of the facepiece 24 referring again to FIG. 4, is formed of a cylindrically-shaped housing member 180 having an outwardly extending conically-shaped inlet wall member 182 including orifices 184. The wall member 182 is formed with a terminal apex portion 186 providing a contact point for the pin 156 of the flap valve member 152, as more fully hereinafter described. An outer surface portion 188 of the housing member 180 is formed with a cylindrically-shaped groove 190 including a gasket member 192 and a cylindrically-shaped locking groove 194.

An electronic readout assembly 196, referring to FIG. 3, may be connected at one end to the lead 172 and connecting at another end via a battery 198 to the lead 176. The readout assembly is capable of displaying operative-inoperable mode or connection of the valve assembly 22 to the connecting assembly 26 we well as being connectable (not shown) to serve as a battery-conserving switch when used with other assemblies for displaying desired states of readiness, etc.

In operation, assuming positioning by the user of the supporting carrier assembly 12 upon the user's back and the proper positioning of the facepiece 24 on the face of the user and the opening of the regulator valve 16 to permit availability of breathing gas from the container 14 to the pressure demand regulatory 18, the valve assembly 22 is caused to be positioned on the air connect member 26 of the facepiece 24. In this condition, air is initially delivered to valve assembly 22 via conduits 116 and 122, and will immediately cease as pressure increases in mixing chamber 144, and is fed back through conduits 122 and 118, causing lever 98 to close valve assembly 56, as more fully described hereinafter. In positioning of the valve housing assembly 22, referring to FIG. 4, on the gas connect member 26 (as indicated by the arrow "A"), the pin member 156 of the flap valve member 152 contacts the apex portion 186 of the wall member 182 of the housing member 180 whereby the flap member 152 is caused to pivot counterclockwise (as indicated by the arrow "B") about the upper arm portion 154 of the flap member 152. Positioning of the valve housing assembly 22 over the connect member 26 is continued to the point where the U-shaped spring member 148 disposed in the groove 146 in the front wall portion 134, placed under compression during such positioning, is permitted to clamp into the groove 194 formed in the housing 180 of the gas connect member 26 thereby affixing the valve housing assembly 22 to the gas connect member 26 of the facepiece 24. During such positioning, regulated access is permitted to the breathing gas from the cylinder 14 by the user through the pressure demand regulator, as described hereinafter.

Upon completion of positioning of the valve housing assembly 22 on the gas connecting member 26 of the facepiece 24, as shown in FIG. 3, the arm member 166 of the spring member 162 is placed in contact with the contact 174 thereby closing the circuit between the battery 190 and related leads together with the readout assembly 196 to energize appropriate LED to visually provide to the user a positive connect mode between the valve housing assembly 22 and the gas connect member 26.

In an inhalation-exhalation condition of the user, referring more particularly to FIG. 2 and incidentally to FIG. 1, upon initiation and continuing to full inhalation, a reduction in pressure is caused to exist in the mixing chamber 144 of the valve housing assembly 22. Such reduction in pressure is pressure sensed in the chamber 46 of the demand regulator assembly 18 via the conduits 132 and 118 against the ambient pressure in chamber 44 thereof via the apertures 48 formed in the upper housing 32 of the demand regulator assembly 18. Such sensed pressure reduction results in a pressure differential with ambient pressure being greater to cause the lever 96 to pivot or rotate counterclockwise (as indicated by arrow "C") about the shaft 100 thereby permitting the piston 60 to slide from left to right as a result of the pressure of the gas in the channel 82 of the nozzle 62, i.e. the gas pressure in the channel 82 is greater than the compressed force of the spring 88 thereby permitting gaseous flow of breathing air through the nozzle opening 84 into the surrounding chamber 92 and thence via the orifice 90 conduits 116 and 120 to the mixing chamber 144 of the gas connect member 26 to augment the inhalation medium. The piston 60 is spring-loaded to a force low enough to allow the gas pressure to open the nozzle 62-valve pad 80 assembly thereby providing a "fail-open" configuration.

Upon changing to an exhalation mode, there is a pressure increase in the mixing chamber 144 of the gas connect member 26 pressure-sensed in the chamber 46 of the demand regulator assembly 18 via the conduits 132 and 118 whereupon reaching a pressure greater than ambient pressure, the lever arm 98 of the lever assembly 96 is caused to rotate clockwise thereby causing the adjusting screw member 108 of the lever arm 104 to push against the rod 70 of the piston 60 and together with the available compression force of the spring 88 to overcome the pressure of the gas exiting the nozzle tip member 84 of the intermediate nozzle member 62 and eventually seat the seal member or valve pad 80 against the nozzle tip member 84 thereby arresting further gas flow therethrough. It will be understood by one skilled in the art that depending on the concomitant inhale/exhale cycle that gaseous flow is cyclic from 0 to 100 percent flow.

Generally, the lever arm assembly 96 provides about 75 percent of the force necessary to effect a seal between the seal member or valve pad 80 and the nozzle tip member 84, the remaining force provided by compression forces of the spring 88 as against the available pressure level of breathing gas available to the gas inlet from the gaseous cylinder 14 via the pressure reduction valve 16.

Upon completion of a use period, the user depresses a button member 200 (FIG. 3) on the valve housing assembly 22 to effect expansion of the U-shaped spring member 148 to permit the spring member to retract from the groove 194 of the housing member 180 of the gas connect member 16 permitting withdrawal of the valve housing assembly 22 from the gas connect member 26 permitting withdrawal of the valve housing assembly 22 from the gas connect member 26 (a direction opposite to the direction of arrow "A"). During withdrawal of valve housing assembly 22, the compression forces of the flap member 152 generated through the arm portion 164 of the spring member 162 causes the flap member 152 to rotate or pivot counterclockwise to effect sealing of the resilient flap member 152 against the bead 160 formed on the front wall member 134 of the valve housing assembly 22. The sealing of the flap member 152 against the bead 160 effectively discontinues further gaseous flow out of the valve housing assembly 22 from the air or gas cylinder 14 via the pressure regulator 16, demand regulator assembly 18, conduit assembly 20 and associated conduits, etc.

Figure 5:
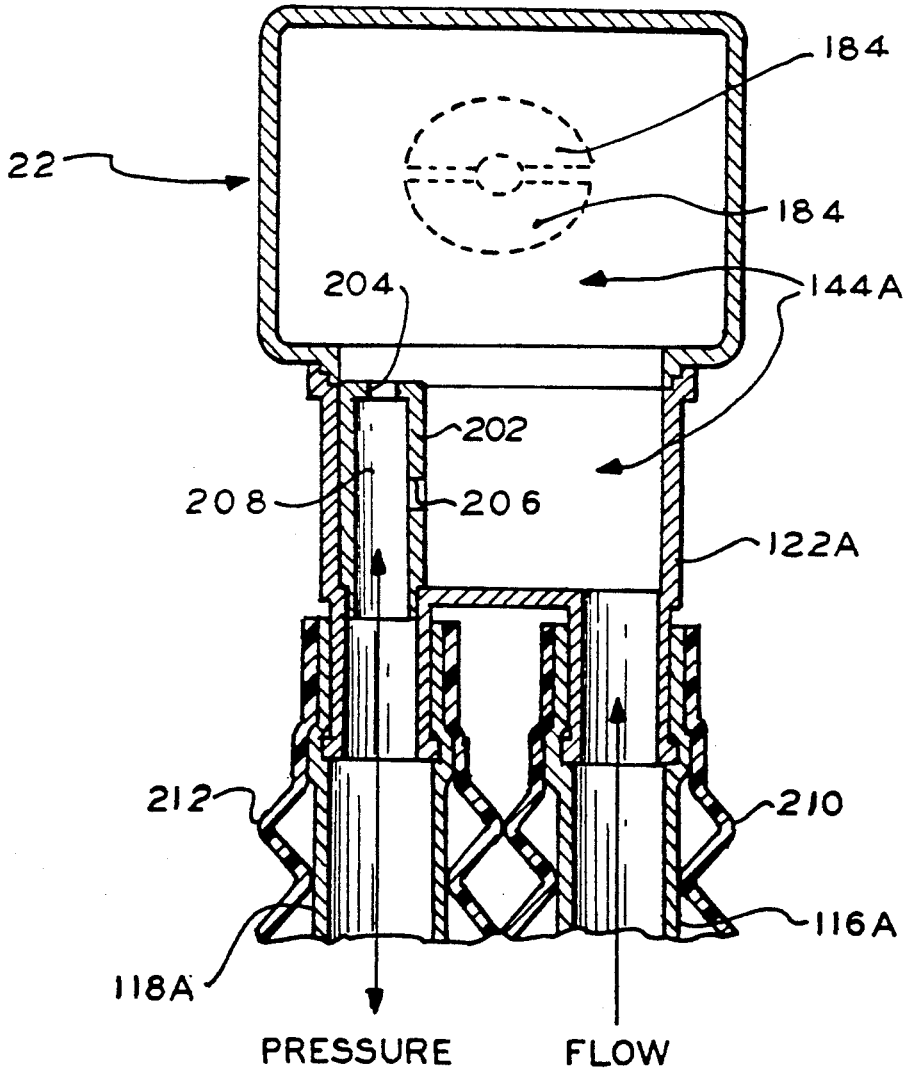
FIG. 5 is a diagrammatical illustration of an alternate embodiment of the present invention and is similar to FIG. 3.

Referring now to FIG. 5, an alternate embodiment of the breathing assembly of the present invention is illustrated, and it will be understood that except for the new structure shown in FIG. 5 the alternate embodiment is the same, or substantially the same, as the embodiments described above and shown in FIGS. 1–4. More particularly, the downwardly extending conduit element 122 of FIGS. 3 and 4 is replaced in the alternate embodiment illustrated in FIG. 5 by the downwardly extending conduit element 122A. In the embodiment of FIG. 5, the downwardly extending conduit element 122A is suitably connected to the connecting assembly 22 instead of being formed as an integral part thereof as is downwardly extending conduit element 122 as shown in FIGS. 3 and 4; however, it will be understood that this is a matter of design and molding costs considerations. The mixing, or expansion chamber 144A, corresponds to mixing chamber 144 shown in FIG. 3.

The downwardly extending conduit element 122A, FIG. 5, includes a generally cylindrical member 202, suitably secured thereto, or molded as a part thereof, provided at its end portion extending toward the chamber 144 with an opening 204 smaller in diameter than the transverse cross-section of the internal cylindrical passageway 208 extending longitudinally through the cylindrical member 202. It will be further understood that the flow conduit 116A of FIG. 5 communicates pressurized breathing gas to the facemask 24 (FIG. 1) from the supply tank 14 (FIG. 1) in the same manner that flow conduit 116 of FIG. 1 communicates pressurized breathing gas to the facemask 24 and as described in detail above. Similarly, it will be understood that the pressure sensing conduit 118A functions in the same manner as the pressure sensing conduit 118 shown in FIG. 1 to communicate pressure in the facemask 24 to the lower chamber 46 on the underside of the diaphragm 38 shown in FIG. 2 to operate the lever 96 to alternately open and close the air valve release assembly 56 including the nozzle 62 and valve pad 80, also shown in FIG. 2, to alternately communicate and interrupt the flow of pressurized breathing gas from the tank 14, FIG. 1, through the orifice 90 and the flow conduit 116 or 116A, the chamber 144 or 144A to the facemask 24 of FIG. 1.

Upon the above-noted valve assembly 56 being opened, the pressurized breathing gas flows through the flow conduit 116 (FIGS. 1, 3 and 4) or 116A (FIG. 5), through the chamber 144 (FIGS. 1, 3 and 4) or 144A (FIG. 5) and therefrom to the facemask 24 of FIG. 1 for inhalation during the inhalation cycle by the wearer of the facemask 24. Upon the pressurized breathing gas exiting the entrances of the flow conduit 116 (FIG. 3) or 116A (FIG. 5) and entering the chamber 144 or 144A, as known to those skilled in the art and in accordance with Bernoulli's Law, the expanding pressurized breathing gas creates a negative pressure which is sensed and communicated to the lower chamber 46 at the underside of the diaphragm 38 (FIG. 1) by the pressure sensing conduit 118 (FIGS. 1, 3 and 4) or 118A (FIG. 5). It has been found that but for the partition 24 of FIGS. 3 and 4, or the cylindrical member 202 of FIG. 5, that this negative pressure can be so great that it cannot be overcome by the positive pressure produced in the facemask 24 during the next exhalation cycle and which positive pressure 24 is communicated by the pressure conduit 118 (FIGS. 1 and 3) or 118A (FIG. 5) to the lower chamber 46 underneath the diaphragm 38. If the negative pressure produced by the expanding pressurized breathing gas and communicated to the lower chamber 46 under the diaphragm 38 cannot be overcome by positive pressure produced in the facemask 24 and communicated to the lower chamber under the diaphragm 38, the negative pressure will hold the diaphragm 38 downwardly thereby keeping the valve assembly 56 open and causing uninterrupted or continuous flow of pressurized breathing gas to the facemask 24 which can unacceptedly interfere with the normal exhalation and breathing cycles of the facemask wearer. However, as taught above, the partition 124 of FIGS. 3 and 4 controls the effect of fluid flow upon the pressure sensing conduit line 118. More particularly, the partition 124 of FIGS. 3 and 4, and the cylindrical member 202 of FIG. 5, reduce the amount of negative pressure produced by the expanding breathing gas which is communicated through the pressure sensing conduit 118 or 118A to the lower chamber 46 under the diaphragm and thereby substantially prevent the valve assembly 56 including the nozzle 62 and valve pad 80 from remaining open as noted above and causing the above-noted undesirable continuous or uninterrupted flow of pressurized breathing gas to the facemask 24.

Upon the pressurized breathing gas exiting the entrance of the flow conduit 116A into the mixing or expansion chamber 144A, such pressurized breathing gas, as noted above, first expands producing the above-noted negative pressure, and then the pressurized breathing gas flows upwardly into the chamber 144A and engages the upper portions of the walls defining the upper chamber 144A of the mask connecting assembly 22 whereupon turbulence is created in the pressurized breathing gas prior to its entrance into the orifices 184 of the facemask 124 of FIG. 1 (the orifices 184 are shown in dashed outline in FIG. 5 and in solid outline in FIG. 4). Such turbulence creates a positive pressure in the upper portion of the chamber 144A (FIG. 5) and this positive pressure is sensed and communicated by the pressure sensing conduit 118A to the lower chamber 46 under the diaphragm 38 of FIG. 1. The embodiment of FIG. 5, particularly downwardly extending conduit element 122A and cylindrical member 202, controls the effect of the expanding pressurized breathing gas upon entering the chamber 144A before flowing into the facemask 24 by reducing, or substantially neutralizing, the effect of the negative pressure produced by the expanding pressurized breathing gas by substantially canceling the effect of such negative pressure by the positive pressure created by the turbulence produced in the expanding pressurized breathing gas upon the gas striking the upper portion of the walls of the chamber 144A before entering the facemask entrance orifices 184. As known from Bernoulli's Law as indicated above, the pressurized breathing gas upon exiting the entrance of the flow conduit 116A into the chamber 144A produces negative pressure which, according to Bernoulli's Law, increases by a square of the velocity ($V^2$) of the gas and, as is further known from Bernoulli's Law, upon the expanding pressurized breathing gas striking the upper portion of the walls of the chamber 144A before entering the facemask entrance orifices 184A, turbulence occurs and the positive pressure created by the turbulence increases also as a function of the square of the velocity ($V^2$).

It will be further understood that, in the embodiment of FIG. 5, the opening 206 provided in the side portion of the cylindrical member 202 may be considered to be a suction hole through which negative pressure produced by the expanding pressurized breathing gas upon entering the mixing or expansion chamber 144A is sensed and communicated through the pressure sensing conduit 118A to the underside of the diaphragm 38 in FIG. 1. Because such negative pressure increases as a function of the square of the velocity of the pressurized breathing gas ($V^2$), there is a parabolic relationship of such negative pressure communicated under the diaphragm 38 (FIG. 1) as the velocity of the pressurized breathing gas increases upon exiting the flow conduit 116A and entering the chamber 144A thereby causing the diaphragm 38 (FIG. 2) to tend to be drawn down uncontrollably at high flows of pressurized breathing gas. Such uncontrollable drawing down of the diaphragm 38 causes, or tends to cause, the valve assembly 46 (FIG. 2) to remain open thereby causing the above-noted constant or uninterrupted flow of pressurized breathing gas unwantedly to the facemask 24. It will be further understood that the opening 204 in the top of the cylindrical member 202 may be considered to be a pressure feedback hole which feeds positive pressure back to the pressure sensing conduit 118A, FIG. 5, which positive pressure offsets the effect of the above-noted negative pressure communicated to the pressure sensing conduit 118 through the opening 206, or suction hole. Such positive pressure is proportional to the above-noted negative pressure sensed through side open opening 206 because both are increasing as a function of the square of the velocity of the pressurized breathing gas ($V^2$) and since this positive pressure is fed back into the cylindrical member 202 through the opening at the top thereof 204, such positive pressure offsets, or at least tends to offset, the negative pressure sensed through the side or suction hole 206 in the cylindrical member 202 causing a controlled or linear response of the regulator diaphragm 38 to increasing flow rates in the pressurized breathing gas upon entering the chamber 144A. With such control or linearization, the positive and negative pressures produced in the facemask 24 by the wearer during the exhalation and inhalation cycles can control the diaphragm 38 which therefore remains responsive to the facemask wearer's normal or natural inhalation and exhalation breathing cycles.

The flow conduit 116A and pressure sensing conduit 118A may be covered individually by suitable corrugated coverings or hoses 210 and 212.

While the invention has been described in connection with an exemplary embodiment thereof, it will be understood that many modifications will be apparent to those of ordinary skill in the art; and that this application is intended to cover any adaptations of variations thereof. Therefore, it is manifestly intended that this invention be only limited by the claims and the equivalents thereof.

We claim:

1. A gas connecting assembly for a breathing assembly including a facepiece and a source of compressed breathing gas, which comprises:

a cylindrically-shaped housing member mounted to said facepiece, said housing member formed with an outwardly extending wall including an orifice; and a mounting member formed with a mixing chamber and a cylindrically-shaped opening, said mounting member for being mounted on said housing member, said mounting member including conduit means for fluid communication between said mixing chamber and a pressure demand regulator valve assembly including a conduit for compressed breathing gas, said mounting member having a wall member movable to a position covering said opening.

2. The gas connecting assembly for a breathing assembly as defined in claim 1 wherein said outwardly extending wall of said housing member is conically-shaped.

3. A gas connecting assembly for a breathing assembly as defined in claim 1 wherein said wall member is spring loaded to said position covering said opening in said mounting member.

4. The gas connecting assembly for a breathing assembly as defined in claim 3 wherein an outer surface of said housing member is formed with grooves, one of said grooves receiving an interlocking member positioned on said mounting member.

5. The gas connecting assembly for a breathing assembly as defined in claim 4 and further including on said mounting member means for releasing said interlocking member from said housing member.

6. The gas connecting assembly for a breathing assembly as defined in claim 1 wherein said wall member is formed of a resilient material.

7. The gas connecting assembly for a breathing assembly as defined in claim 6 wherein said outwardly extending wall of said housing member is conically-shaped and is coextensive with said mixing chamber of said mounting member to facilitate gaseous flow to said facepiece.

8. The gas connecting assembly for a breathing assembly as defined in claim 6 and further including a metallic support member mounted to a center portion of said wall member and having a first leg portion in sliding contact with said wall member of said mounting member.

9. The gas connecting assembly for a breathing assembly as defined in claim 8, wherein said metallic support member has a second leg portion, wherein said wall member of said mounting member includes a first electrical lead connected to said first leg portion and a second electrical lead to be contacted by said second leg portion of said metallic support member.

10. The gas connecting assembly for a breathing assembly as defined in claim 9 wherein said electrical leads are connected to a source EMF and a status readout assembly.

11. Apparatus for connecting breathing gas conduit means to a breathing device used by a user of breathing gas, said breathing gas conduit means for being connecting to a source of breathing gas and said breathing device including a breathing gas connect member provided with a first opening for admitting breathing gas into said breathing device, comprising:

breathing gas connecting assembly for being connected to said breathing gas conduit means and for being releasably connected to said breathing gas connect member, said connecting assembly provided with a second opening for admitting said breathing gas into said first opening;

normally closed valve means provided on said connecting assembly and normally closing said second opening, upon said connecting assembly being connected to said breathing gas connect member said valve means being engaged by said breathing gas connect member and opened thereby whereupon said valve means opens said second opening to admit said breathing gas into said first opening;

upon said connecting assembly being disconnected from said breathing gas connect member said valve means closing to prevent entry of debris through said second opening into said connecting assembly; and upon said connecting assembly being connected to said breathing gas conduit means and upon said breathing gas conduit means being connected to said source of breathing gas and upon said connecting assembly being disconnected from said breathing gas connect member, said valve means closing to prevent escape of said breathing gas out of said second opening.

12. The apparatus according to claim 11 wherein said apparatus further comprises an electronic readout assembly for providing a first readout indicative of said connecting assembly being releasably connected to said breathing gas connect member and for providing a second readout indicative of said connecting assembly being disconnected from said breathing gas connect member, said electronic readout assembly operatively connected to said valve means, and said valve means upon being opened operating said electronic readout means to provide said first readout and said valve means upon being closed operating said electronic readout means to provide said second readout.

13. The apparatus according to claim 11 where said apparatus further comprises resilient connecting means mounted on said breathing gas connecting assembly for releasably connecting said breathing gas connecting assembly to said breathing gas connect member.

14. The apparatus according to claim 11 wherein said connecting assembly includes a first wall provided with an opening providing said second opening and a sealing member adjacent said opening, a second wall generally opposite said first wall and including an inner surface, a resilient closure member mounted to said inner surface and provided with a predetermined shape biasing said closure member into sealing engagement with said sealing member to close said second opening, and upon said connecting assembly being releasably connected to said breathing gas connect member, said breathing gas connect member engaging said closure member to move said closure member out of said sealing engagement with said sealing member to open said second opening and upon said connecting assembly being disconnected from said breathing gas connect member said resilient closure member returning into engagement with said sealing member to close said second opening.

15. The apparatus according to claim 14 wherein said valve means further includes a spring member provided with a predetermined shape and mounted to said resilient closure member and generally in engagement with said inner surface of said second wall, upon said resilient closure member being moved out of sealing engagement with said sealing member, said spring member being moved out of said predetermined shape and placed generally in a state of compression and upon said connecting assembly being disconnected from said breathing gas connect member said spring member acting generally against said second wall and assisting in returning said resilient closure member into sealing engagement with said sealing member to close said first opening.

16. The apparatus according to claim 15 wherein said apparatus further comprises an electronic readout assembly for providing a first readout indicative of said connecting assembly being releasably connected to said breathing gas connect member and for providing a second readout indicative of said connecting assembly being disconnected from said breathing gas connect member, and wherein said electronic readout assembly comprises a normally open electric circuit including a source of electrical energy and a pair of electrical contacts mounted on an inner surface of said second wall, said spring member normally engaging one of said electrical contacts and upon said spring member being bent out of said predetermined shape said spring member also engaging said second electrical contact to close said normally open electrical circuit to cause energization of said display and provide said first readout, upon said connecting assembly being disconnected from said breathing gas connect member and upon said closure member being returned to sealing engagement with said sealing member, said spring member returning to said predetermined shape and moving out of engagement with said second electrical contact to reopen said normally open electrical circuit to cause said display device to provide said second readout.

17. Facepiece interconnect assembly for interconnecting a source of breathing gas to a facepiece for being worn by a user of said breathing gas, comprising:

a housing provided with first and second openings, said first opening for being connected to said source of breathing gas and said second opening for being connected to said facepiece; and normally closed valve means mounted in said housing and for normally closing said housing to prevent entry of debris through said second opening into said housing and said normally closed vale means for being opened by the act of connecting of said second opening to said facepiece to permit flow of said breathing gas through said housing and said second opening into said facepiece.

18. Facepiece interconnect assembly for interconnecting conduit means connected to a source of breathing gas to facepiece for being worn by a user of said breathing gas, comprising:

a housing provided with first and second openings, said first opening for being connected to said conduit means and said second opening for being connected to said facepiece; and normally closed valve means mounted in said housing, upon said second opening being connected to said facepiece said normally closed valve means being opened by the act of connecting said second opening to said facepiece to permit flow of said breathing gas from said source, through said housing and through said first opening into said facepiece and upon said second opening being disconnected from said facepiece said normally closed valve means being closed to prevent entry of debris into said housing and into said conduit means.

19. Breathing assembly, comprising:

a facepiece for being worn by a use of pressurized breathing gas which user produces inhalation and exhalation cycles of said breathing gas, said inhalation cycle producing reduced pressure in said facepiece and said exhalation cycle producing increased pressure in said facepiece;

pressure demand regulator connected to a source of pressurized breathing gas;

first and second conduit means connected intermediate said pressure demand regulator and said facepiece, said first conduit means for communicating said reduced pressure in said facepiece to said pressure demand regulator to cause said pressure demand regulator to communicate said pressurized breathing gas to said facepiece and said user through said second conduit means and said first conduit means for communicating said increased pressure in said facepiece to said pressure demand regulator to cause said pressure demand regulator to cease supply of said pressurized breathing gas to said facepiece and said user through said second conduit means;

upon said pressurized breathing gas being supplied to said facepiece and said user through said second conduit means, said flow of pressurized breathing gas through said second conduit means effecting the production of a reduced pressure in said first conduit means which is communicated through said first conduit means to said pressure demand regulator to tend to cause the uninterrupted cessation of supply of pressurized breathing gas to said user; and control means for controlling the ability of said flow of said pressurized breathing gas through said second conduit means to effect said production of said reduced pressure in said first conduit means.

20. The breathing assembly according to claim 19 wherein said first and second conduits have exits proximate said facepiece and wherein said control means comprise a partition intermediate said first and second conduit means at said exits, said partition including at least a portion inclined from said first conduit means toward said second conduit means and for deflecting the flow of said pressurized breathing gas through said second conduit means away from said first conduit means.

21. The breathing assembly according to claim 19 wherein said first and second conduit means have exits proximate said facepiece and wherein said control means comprise a member intermediate said first and second conduit means adjacent said exits and wherein said member has an opening therein placing said first and second conduit means in fluid communication with each other through said opening, and upon said flow of pressurized breathing gas through said second conduit means effecting the production of said reduced pressure in said first conduit means said flow of said pressurized breathing gas through said second conduit means also effecting the production of an increased pressure in said first conduit means through said opening which increased pressure tends to cancel said reduced pressure produced in said first conduit means due to said flow of said pressurized breathing gas through said first conduit means.

22. Breathing assembly, comprising:

a facemask;

a pressure demand regulator including a diaphragm and valve means;

chamber means intermediate said facemask and said pressure demand regulator, said chamber means providing a chamber;

first and second conduits intermediate said chamber means and said pressure demand regulator;

said chamber means having an entrance, and said first conduit is operatively connectable to said chamber means at said entrance;

said first conduit for communicating pressure in said facemask through said chamber and to said diaphragm means to cause said diaphragm means to operate said valve means to communicate said pressurized breathing gas through said second conduit means and through said chamber to said facemask;

control means mounted at the entrance of said first and second conduits into said chamber for controlling the effect of said pressurized breathing gas upon entering said chamber upon the pressure sensed by said diaphragm through said first conduit.

23. The breathing assembly according to claim 22 wherein said control means comprise a partition extending between the entrance of said first conduit into said chamber and the entrance of said second conduit into said chamber.

24. The breathing assembly according to claim 23 wherein said partition includes an end portion inclined toward said second conduit.

25. The breathing assembly according to claim 22 wherein said control means comprise a generally hollow cylindrical member extending between said first conduit and said chamber.

26. The breathing assembly according to claim 25 wherein said cylindrical member includes a side portion extending towards the entrance of said second conduit into said chamber and wherein an opening is formed in said side portion for communicating to said first conduit negative pressure produced by the expansion of said breathing gas in said chamber.

27. The breathing assembly according to claim 26 wherein said cylindrical member includes an end portion extending towards said chamber, wherein said end portion is provided with a second opening for communicating to said first conduit positive pressure produced by turbulence created in said breathing gas in said chamber before said gas enters said facemask.

28. The breathing assembly according to claim 27 wherein said cylindrical portion is provided with an internal passageway extending longitudinally therethrough and wherein the size of said second opening is smaller than the transverse size of said internal passageway.

* * * * *